US008300000B2

(12) United States Patent
Shi

(10) Patent No.: US 8,300,000 B2
(45) Date of Patent: Oct. 30, 2012

(54) LIQUID CRYSTAL DISPLAY DEVICE AND DRIVING METHOD THEREOF WITH VARYING LINE ROW INVERSIONS

(75) Inventor: Rui-Fu Shi, Shenzhen (CN)

(73) Assignee: Chimei Innolux Corporation, Miaoli County (TW)

( * ) Notice: Subject to any disclaimer, the term of this patent is extended or adjusted under 35 U.S.C. 154(b) by 587 days.

(21) Appl. No.: 12/454,876

(22) Filed: May 26, 2009

(65) Prior Publication Data

US 2009/0289928 A1 Nov. 26, 2009

(30) Foreign Application Priority Data

May 23, 2008 (CN) ..... 2008 1 0067420

(51) Int. Cl.
*G09G 3/36* (2006.01)

(52) U.S. Cl. ..... 345/96; 345/209

(58) Field of Classification Search ..... 345/87, 345/94, 96, 209
See application file for complete search history.

(56) References Cited

U.S. PATENT DOCUMENTS 6,342,876 B1 1/2002 Kim
7,030,843 B2 * 4/2006 Youn ..... 345/86
7,714,833 B2 * 5/2010 Kamio ..... 345/103
2003/0197815 A1 10/2003 Choi et al.
2005/0146490 A1 * 7/2005 Kang et al. ..... 345/76
2006/0001638 A1 * 1/2006 Jeon et al. ..... 345/100
2006/0028463 A1 * 2/2006 Nakamura et al. ..... 345/204
2009/0058782 A1 * 3/2009 Watanabe et al. ..... 345/94
2009/0135171 A1 * 5/2009 Chen et al. ..... 345/211

FOREIGN PATENT DOCUMENTS

CN 1783195 A 6/2006
KR 20010004914 A 1/2001

* cited by examiner

*Primary Examiner* — Chanh Nguyen
*Assistant Examiner* — Kwang-Su Yang
(74) *Attorney, Agent, or Firm* — Bacon & Thomas, PLLC

(57) ABSTRACT

A liquid crystal display (LCD) device with a driving method includes an LCD panel, a data driving circuit, a common voltage generating circuit, and a gate driving circuit. The LCD panel includes multiple data lines and multiple scanning lines intersecting with the data lines, and a common electrode. The gate driving circuit provides multiple gate-scanning signals to scan the scanning lines. The common voltage generating circuit provides a common voltage to the common electrode. The data driving circuit provides a gray level voltage signal including multiple voltage levels to the data lines. The common voltage is serial square waves having at least two non-identical frame periods. The square waves in each non-identical frame period of the common voltage in one frame have a constant period.

10 Claims, 10 Drawing Sheets

LIQUID CRYSTAL DISPLAY DEVICE AND DRIVING METHOD THEREOF WITH VARYING LINE ROW INVERSIONS

CROSS-REFERENCE TO RELATED APPLICATION

This application is related to, and claims the benefit of, a foreign priority application filed in China as Serial No. 200810067420.6 on May 23, 2008. The related application is incorporated herein by reference.

BACKGROUND

1. Technical Field

The present disclosure relates to liquid crystal display, and more particularly to an LCD device and driving method thereof.

2. Description of Related Art

In a commonly used thin film transistor liquid crystal display (TFTLCD), content is displayed by rotating liquid crystal (LC) molecules inside the TFTLCD to specific attitudes to control a transparency (brightness) with adjusting bias voltages loaded to two sides of the TFTLCD. The LC molecules are permanently damaged and no longer rotate smoothly if electric fields generated by the bias voltages remain in the same direction for a long time. Hence, to prevent permanent damage, different driving methods with alternative directions of the bias voltages are provided, such as frame inversion, column inversion, line/row inversion and, dot inversion. Row inversion includes 1-line and 2-line row driving methods.

FIG. 11 shows a driving motion of the 1-line row inversion driving method. All pixels in a specific row in each frame have the same bias direction, with two adjacent rows having inverse (opposite) bias direction. That is, the rows during each frame are driven in alternate bias directions. During a subsequent frame period, all pixels of the specific row have an inverted bias direction. Therefore, the bias direction of each pixel of the TFTLCD is alternately driven frame by frame.

With reference to FIGS. 12 and 13, a 1-line row flicker pattern and a driving motion analysis corresponding to the flicker pattern are shown. In FIG. 12, empty boxes represent pixels displaying identical brightness, and shaded blocks present pixels displaying an unilluminated state. In FIG. 13, pixels in the illuminated state are marked by circles, and pixels in the unilluminated state are shown without circles. The TFTLCD successively displays images corresponding to the frames "n", "n+1", "n+2" . . . and so on, and the bias direction of each specific row is driven alternatingly. As shown in FIG. 13, a first row is continuously in the unilluminated state but is successively driven by bias voltages having negative ("−"), positive ("+") and negative ("−") bias directions respectively during frames n, n+1 and n+2. Hence, LC molecules in the rows are preserved with good characteristics.

Typically, a sequential square wave is input to a common electrode of the TFTLCD as a Vcom signal, referred to common voltages hereinafter. Periods of the Vcom signal during each frame are the same. Driving voltages applied to electrodes of an array side of the pixels in the TFTLCD correspond to the Vcom signal, whereby a bias voltage and a direction of the bias voltage to each pixel is determined. When voltage of the Vcom signal is lower than the driving voltage of a specific pixel, the bias voltage of the specific pixel is defined as being in the positive ("+") bias direction. Otherwise, the bias voltage is defined as being in the negative ("−") bias direction. However in practical use, the common voltages are often shifted and form a non-stable waveform frame by frame. Therefore, brightness of each pixel in one row is slightly changed with transformation of the frames when the TFTLCD displays a static picture as shown in FIG. 13. Hence, since the brightness change in the pixels during frame transformation is visible, flicker occurs.

Referring to FIG. 14, the double-line row inversion diving method is disclosed to solve the flicker problem. The bias voltages of adjacent rows during each frame have the same bias direction. For instance, the bias voltages of the 2n−1 row (where n is an integer) of the TFTLCD has the same bias direction as that of the 2n row. The bias voltages of the 2n+1 and 2n+2 rows have the same bias direction, but have inverse bias direction to the bias direction of the 2n−1 and 2n rows. Also, the bias voltage of each row has different bias direction frame by frame.

FIG. 15 shows a driving motion using the double-line row inversion driving method to solve the flicker problem of FIG. 12. Pixels with circles are defined in the illuminated state. In this example, half pixels in the illuminated state are driven by the bias voltages having positive bias direction, and the other of half pixels displaying the illuminated state are driven by the bias voltages having negative bias direction. The flicker problem is then solved since the brightness of pixels displaying the illuminated state compensate to each other in each frame, such that, the brightness changes (flicker) during frame transformation are no longer discernible.

Unfortunately, the double-line row inversion driving method is not flicker free when displaying sequential frames having two illuminated and two unilluminated rows. FIGS. 16 and 17 respectively show a flicker pattern of 2-line rows and a driving motion analysis corresponding to the same flicker pattern. Empty blocks in FIG. 16 represent pixels displaying illuminated states with identical brightness, and shaded blocks in FIG. 16 represent pixels displaying unilluminated states with the same brightness. In FIG. 17, pixels with illuminated states are marked by circles and pixels in unilluminated states are shown unmarked. Pixels having the same state (that is bright or unilluminated state) are driven by bias voltages having the same bias direction during each frame. In FIG. 17, all illuminated state pixels (circle marked) during frame "n" to "n+2" are alternately driven by bias voltages having positive, negative and positive bias directions respectively, such that the illuminated state pixels during frame transformation again suffer from irregular brightness and flicker.

Neither the 1-line row inversion nor the double line row inversion driving method is able to completely eliminate flicker entirely.

What is needed therefore, is a driving method and LCD that can overcome the limitations described.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Figure 1:
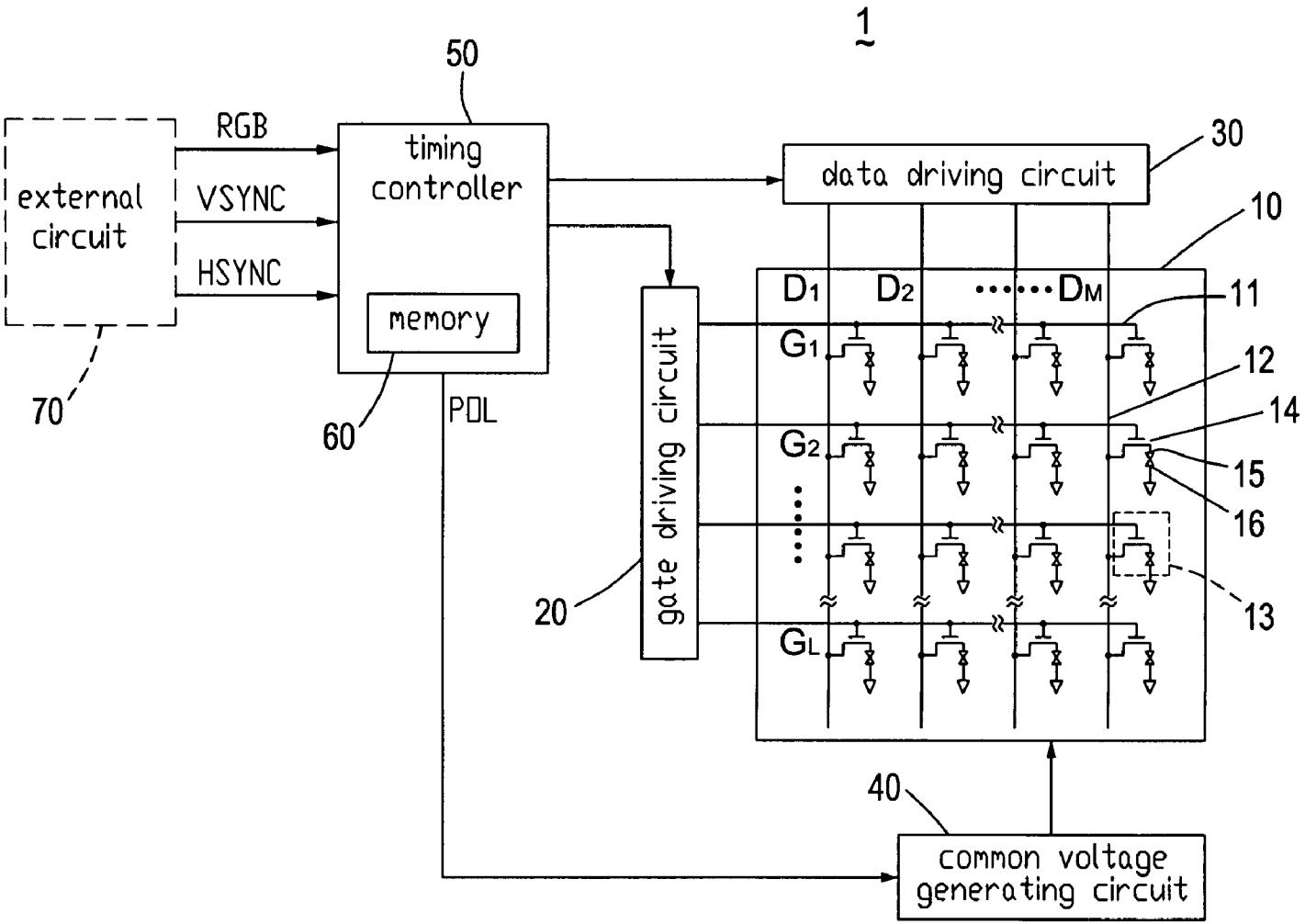
FIG. 1 is a schematic diagram of an LCD device with a driving method in accordance with the present disclosure.

With reference to FIG. 1, an LCD device 1 in accordance with the present disclosure includes an LCD panel 10, a gate driving circuit 20, a data driving circuit 30, a common voltage generating circuit 40, and a timing controller 50. The timing controller 50 has a memory 60 storing a control program therein.

The LCD panel 10 includes multiple gate lines 11, multiple data lines 12, and multiple pixels 13. The gate lines 11 are parallel to each other. The data lines 12 are parallel to each other, and intersect with and are electronically isolated from the gate lines 11. The data lines 12 and the gate lines 11 define multiple intersections where the data lines 12 cross the gate lines 11. Each pixel 13 is defined between four intersections, and includes a thin film transistor (TFT) 14, a pixel electrode 15, a common electrode 16, and a liquid crystal molecular cell sandwiched between the pixel electrode 15 and the common electrode 16. Each TFT 14 is formed adjacent to an intersection of the gate and data lines 11, 12. The pixel electrodes 15 are mounted and allocated between the crossed gate lines 11 and data lines 12. A gate, source and drain electrodes of each TFT 14 are electronically connected to a corresponding gate line 11, a corresponding data line 12, and a corresponding electrode 15 respectively.

An external circuit 70 continuously transmits a tricolor (red, green and blue, RGB) signal and multiple control signals to the timing controller 50. The control signals include a vertical synchronization (VSYNC) signal and a horizontal synchronization (HSYNC) signal.

The VSYNC signal is a starting synchronization signal for a frame display and is a fetch trigger to read the tricolor signals. The HSYNC signal is a starting synchronization signal to a gate scan and is a fetch trigger of all pixels 13 in an on scanning gate line 11 to read the tricolor signals. A period of the HSYNC signal is an interval to scan one gate line 11.

The timing controller 50 receives the tricolor signals and the control signals, and generates a polarity inversion signal POL and multiple sequential signals by the control program in the memory 60 based on the control signals. The timing controller 50 sends the polarity inversion signal POL to the common voltage generating circuit 40, and respectively sends the tricolor signals and corresponding sequential signals to the data driving circuit 30 and the gate driving circuit 20. The polarity inversion signal POL is a serial square wave having at least two non-identical frame periods. The square waves in each non-identical frame period of the polarity inversion signal POL have a constant frame period. During each frame, the polarity inversion signal POL refers to the VSYNC and HSYNC signals and has about 50% duty ratio. The constant frame period of the polarity inversion signal POL in each frame is 2k times to the period of the HSYNC signal, and k is an integer except zero.

Figure 2:
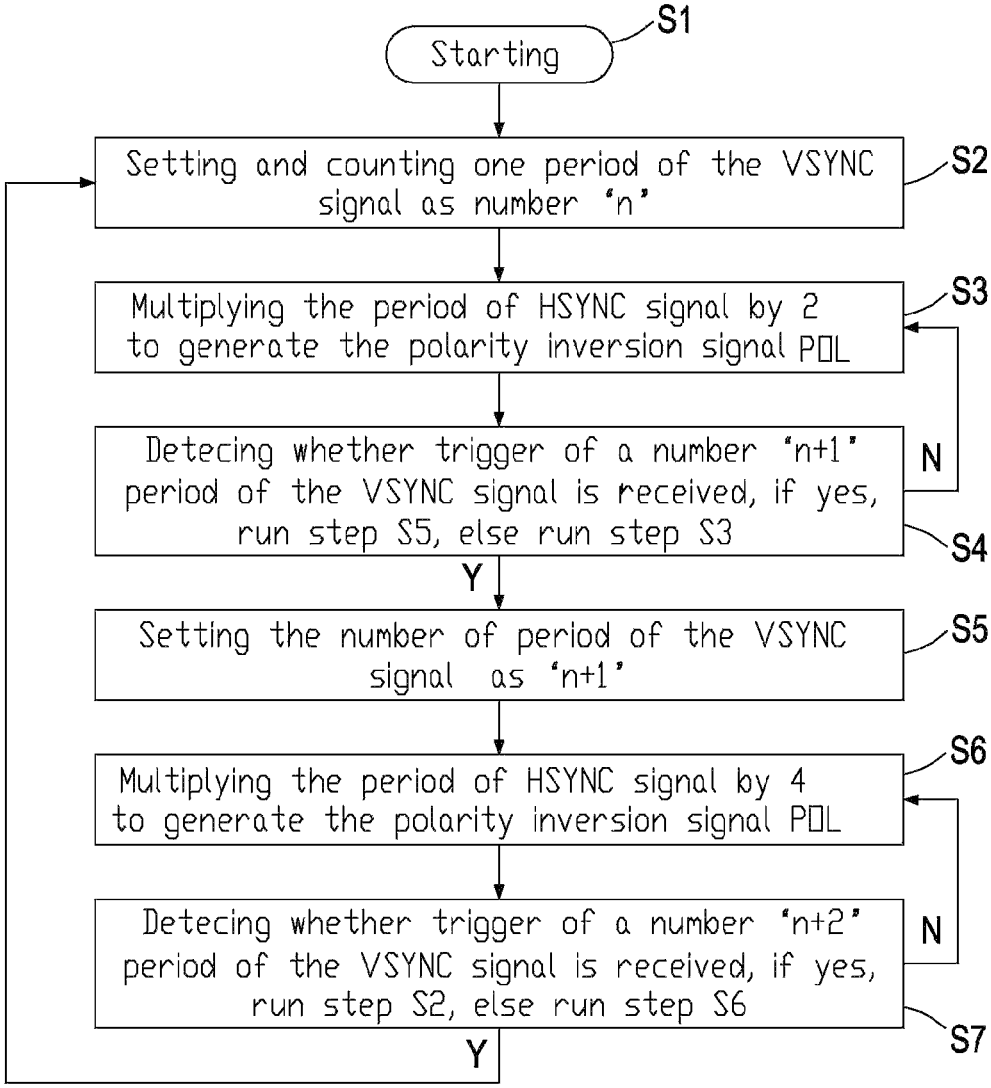
FIG. 2 is a flowchart of a first embodiment of a driving method of an LCD device in accordance with the present disclosure.
Figure 3:
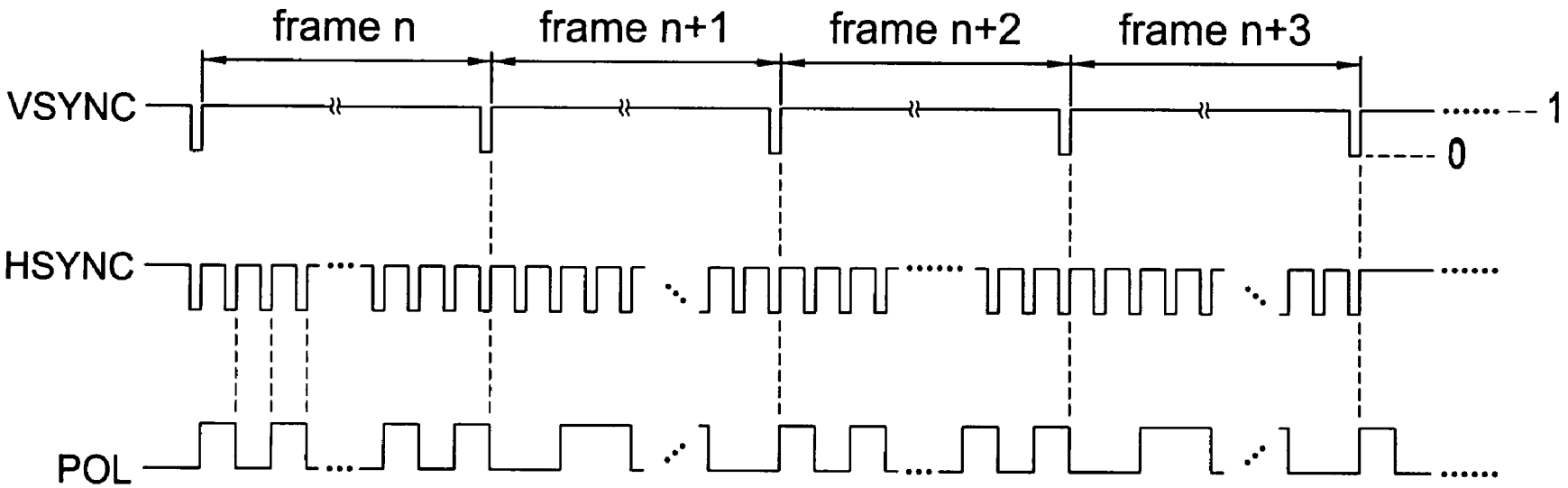
FIG. 3 is a sequence diagram of a VSYNC signal, an HSYNC signal, and a polarity inversion signal POL in the driving method of FIG. 2.

FIG. 2 is a flowchart of a first embodiment of a driving method of an LCD device, and FIG. 3 is a sequence diagram of the VSYNC signal, the HSYNC signal, and the polarity inversion signal POL of the first embodiment. The polarity inversion signal POL generated method is as follows.

In step S1, the method is initiated.

In step S2, one period of the VSYNC signal is set and counted a number "n," where "n" is a positive integer. When the timing controller 50 receives the VSYNC signal and detects a trigger (the voltage of the VSYNC changing from a low level (e.g., a logical zero) to a high level (e.g., a logical one)), the timing controller 50 runs the control program in the memory 60 to set the period of the VSYNC having the trigger as the number "n."

In step S3, the period of HSYNC signal is doubled to generate the polarity inversion signal POL. The timing controller 50 runs the control program in the memory 60 to double the period of HSYNC signal to be the period of the polarity inversion signal POL, and sends the polarity inversion signal POL to the common voltage generating circuit 40.

In step S4, the timing controller 50 determines whether the trigger of a number "n+1" period of the VSYNC signal has been received. If so, step S5 is implemented. If not, step S3 is repeated. The timing controller 50 continuously receives the VSYNC signal and determines whether the number "n+1" trigger of the VSYNC signal has been read, that is, a subsequent frame is to be displayed by the LCD device. If so, the timing controller 50 implements step S5. If not step S3 is repeated.

In step S5, the number of period of the VSYNC signal is set as "n+1."

In step S6, the period of HSYNC signal is multiplied by 4 to generate the polarity inversion signal POL. The timing controller 50 runs the control program in the memory 60 to multiply the period of HSYNC signal by 4 to be the period of the polarity inversion signal POL, and sends the polarity inversion signal POL to the common voltage generating circuit 40.

In step S7, the timing controller 50 determines whether the trigger of a number "n+2" period of the VSYNC signal has been received. If so, step S2 is repeated. If not, step S6 is repeated. The timing controller 50 continuously receives the VSYNC signal and determines whether the trigger of the number "n+2" period of the VSYNC signal has been read, that is, a subsequent frame is to be displayed by the LCD device. If so, the timing controller 50 repeats step S2 If not, step S6 is repeated.

Figure 4:
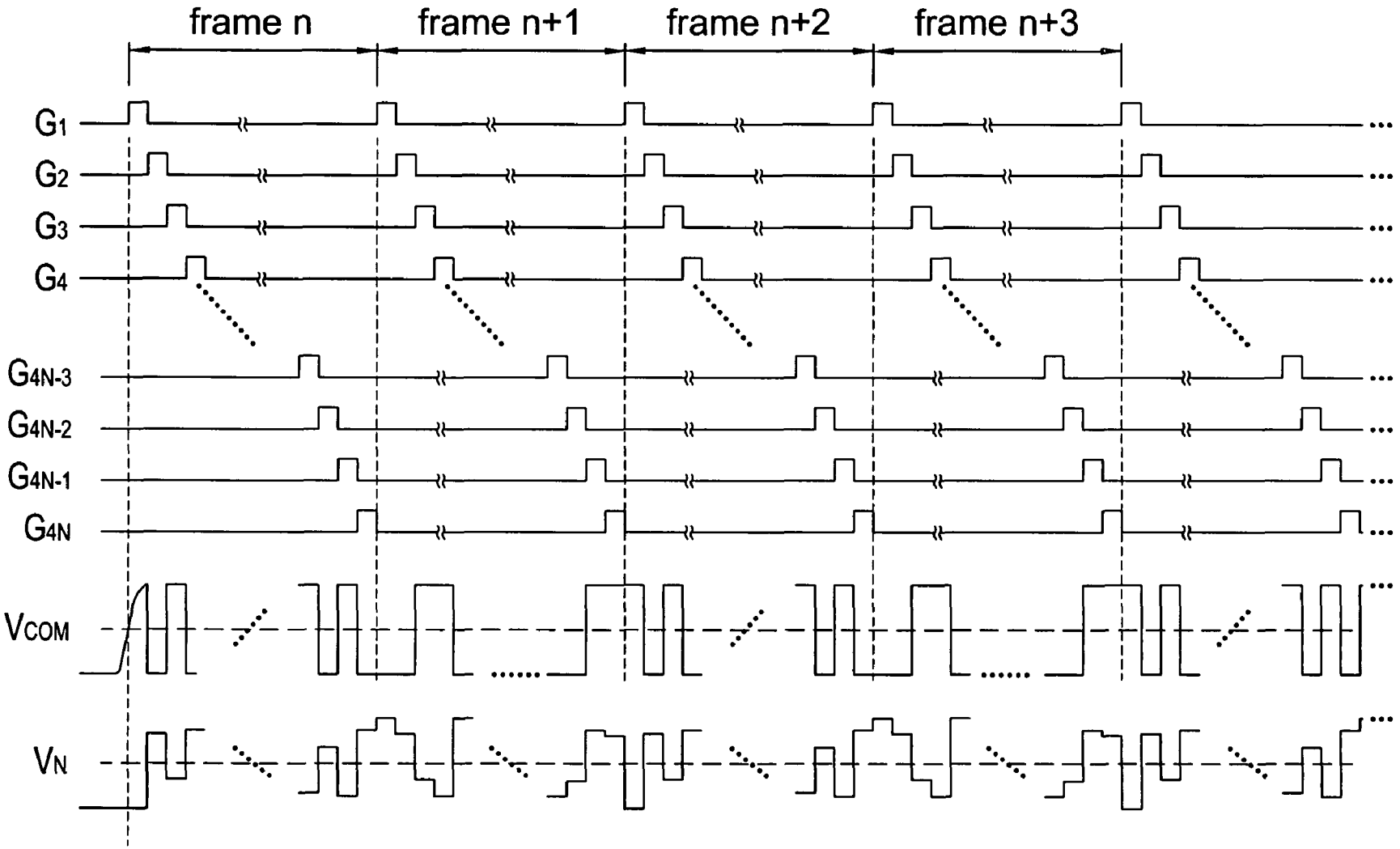
FIG. 4 is a sequence diagram of signals for and LCD panel of the LCD device of FIG. 1.

FIG. 4 is a sequence diagram of the signals to the LCD panel 10. The LCD panel 10 continuously receives multiple gate-scanning signals G1-G4*n*, a gray level voltage (gray scale voltage) signal Vn, and a common voltage VCOM. The gate-scanning signals G1-G4*n* are generated by the gate driving circuit 20, and are respectively sent to the gate lines 11 of the LCD panel 10. The gray level voltage signal Vn generated by the data driving circuit 30 is applied to one of the data lines 12, and includes multiple voltage levels driving the pixels 13 in the data line 12 to display gray levels. The common voltage generating circuit 40 generates the common voltage VCOM according to the received polarity inversion signal POL and sends the common voltage VCOM to the common electrode 16.

The gate driving circuit 20 successively sends the gate-scanning signals G1-G4*n* respectively to the gate lines 11 based on the sequential signals, whereby the TFTs 14 are successively switched on. The period of each gate-scanning signal G1-G4*n* corresponds to one frame and has a duty interval substantially equal to the time interval for scanning one gate line 11.

As one gate line 11 is scanned, the common voltage generating circuit 40 refers to the received polarity inversion signal POL to generate and send the common voltage VCOM having an alternate bias direction to the common electrode 16 of the LCD panel 10. When the received polarity inversion signal POL is a high voltage level, the common voltage generating circuit 40 generates a positive biasing direction common voltage VCOM to the common electrode 16. Otherwise, when the received polarity inversion signal POL is a low voltage level, the common voltage generating circuit 40 generates a negative biasing direction common voltage VCOM to the common electrode 16. Hence, the common voltage VCOM is converted in accordance with the polarity inversion signal POL into a serial square wave having at least two non-identical frame periods, which means that the polarity inversion signal POL is not a signal-frequency (period) square wave. Therefore, a period of the common voltage VCOM of the first embodiment in accordance with FIG. 4 is two frames, and waveforms in the two frames of each period are square waves having non-identical periods. The period of the common voltage VCOM in each frame is 2k times to the period of the HSYNC and has a duty ratio being about 50%.

As one gate line 11 is scanned (on-scanning), the data driving circuit 30 follows the sequential signal and transforms the received tricolor signals to generate the gray level voltage signal Vn. The gray level voltage signal Vn is applied to the pixel electrodes 15 through the TFT 14 in the scanned gate line 11, where the gray level voltage signal Vn is generated by referring to the bias direction of the common voltage VCOM at that time. The pixels in the scanned gate line 11 of the LCD panel 10 are able to display the gray level in accordance with the gray level voltage signal Vn.

Figure 5:
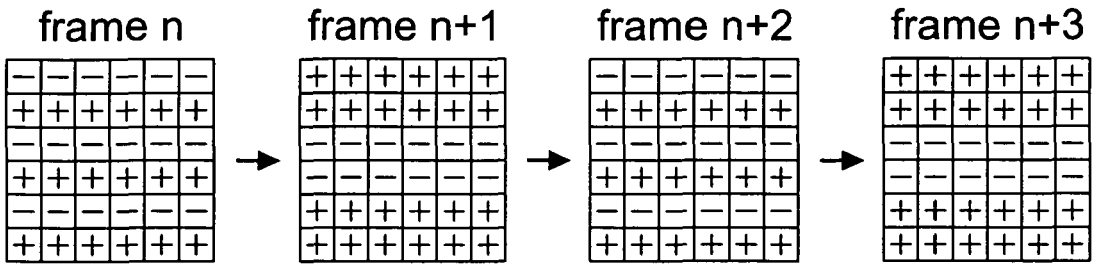
FIG. 5 shows a driving motion of the driving method of FIG. 2.

FIG. 5 shows a driving motion of the driving method of FIG. 2. Frames "n" and "n+2" are driven by 1-line row inversion driving method, and the bias voltage of each pixel 13 has the same bias direction during the two frames "n" and "n+2." The frames "n+1" and "n+3" are driven by 2-line row inversion driving method, and the bias voltage of each pixel 13 has the same bias direction during the two frames "n+1" and "n+3." Hence, the non-identical frame periods of the polarity inversion signal POL may be the frames "n" to "n+1", frames "n+2" to "n+3" and so on.

Figure 6:
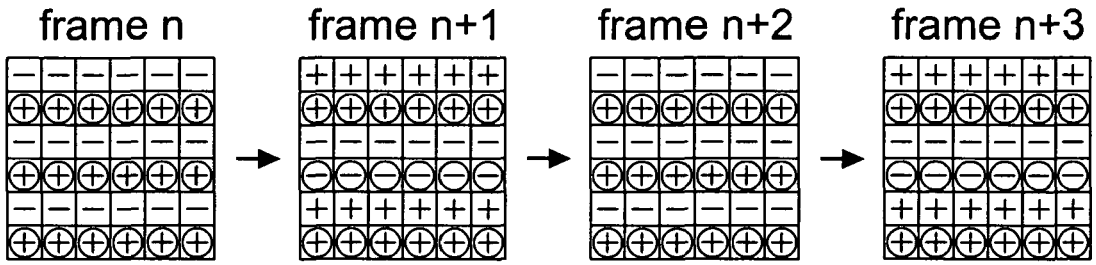
FIG. 6 shows a driving motion analysis of an LCD device displaying a 1-line row flicker pattern, the LCD device utilizing the driving method of FIG. 2.

FIG. 6 shows a driving motion analysis of an LCD device displaying a 1-line row flicker pattern, the LCD device utilizing the driving method of FIG. 2. Circle marked pixels 13 display the illuminated state, and the unmarked pixels 13 display the unilluminated state. When the LCD device 1 is driven by this driving method, during frames "n+1" and "n+3", and part of the pixels 13 in the illuminated state are driven by a positive bias direction gray level voltage signal Vn and the other part of the pixels 13 on the illuminated state are driven by a negative bias direction gray level voltage signal Vn. The brightness difference between the positive-biased and negative-biased pixels 13 in the illuminated state are compensated with each other, thereby the brightness difference between the frame "n" and "n+1", "n+2" and "n+3" are reduced to be non-identifiable. That is, no flicker is identifiable.

Figure 7:
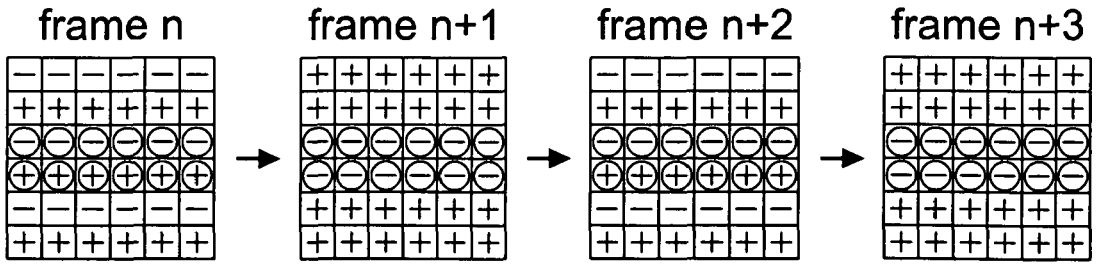
FIG. 7 is a driving motion analysis of an LCD device displaying a 2-line row flicker pattern, the LCD device utilizing the driving method of FIG. 2.

FIG. 7 is a driving motion analysis of an LCD device displaying a 2-line row flicker pattern, the LCD device utilizing the driving method of FIG. 2. Circle marked pixels 13 display the illuminated state, and the unmarked pixels 13 display the unilluminated state. When the LCD device 1 is driven by the aforementioned driving method in accordance with the first embodiment, during frames "n" and "n+2", a part of the pixels 13 on the illuminated state are driven by a positive bias direction gray level voltage signal Vn and another part of the pixels 13 in the illuminated state are driven by a negative bias direction gray level voltage signal Vn. The brightness difference between 13 on the illuminated state are compensated with each other. Therefore, the brightness variation from a previous frame to the frame "n" and the brightness variation from the frame "n+1" to the frame "n+2" are reduced and unrecognizable. That is, no flicker is identifiable.

In summary, the timing controller 50 reads and runs the control program in the memory 60, generates the polarity inversion signal POL based on the received VSYNC and HSYNC signals. The common voltage generating circuit 40 receives the polarity inversion signal POL and sends the common voltage VCOM with alternate positive and negative bias directions to the common electrode 16. The common voltage VCOM is a bias direction alternating voltage signal in accordance with the polarity inversion signal POL, and has a period covering two frames. Periods of waveforms of the common voltage VCOM in the two frames are non-identical. One period of one of the waveforms of the common voltage VCOM is twice the period of the gate-scanning signals G1-G4*n*. Another period of the other one of the waveforms of the common voltage VCOM is four times to the period of the gate-scanning signals G1-G4*n*. The data driving circuit 30 sends the gray level voltage signal Vn corresponding to the common voltage VCOM to the pixel electrodes 15. Therefore, when the 1-line row inversion and the 2-line row inversion driving method are combined, the bias voltages provided to the pixels 13 on the illuminated state are not in a same bias direction. Thus, the brightness difference between adjacent frames does not exist or is not discernible. Flicker is then substantially eliminated.

Figure 8:
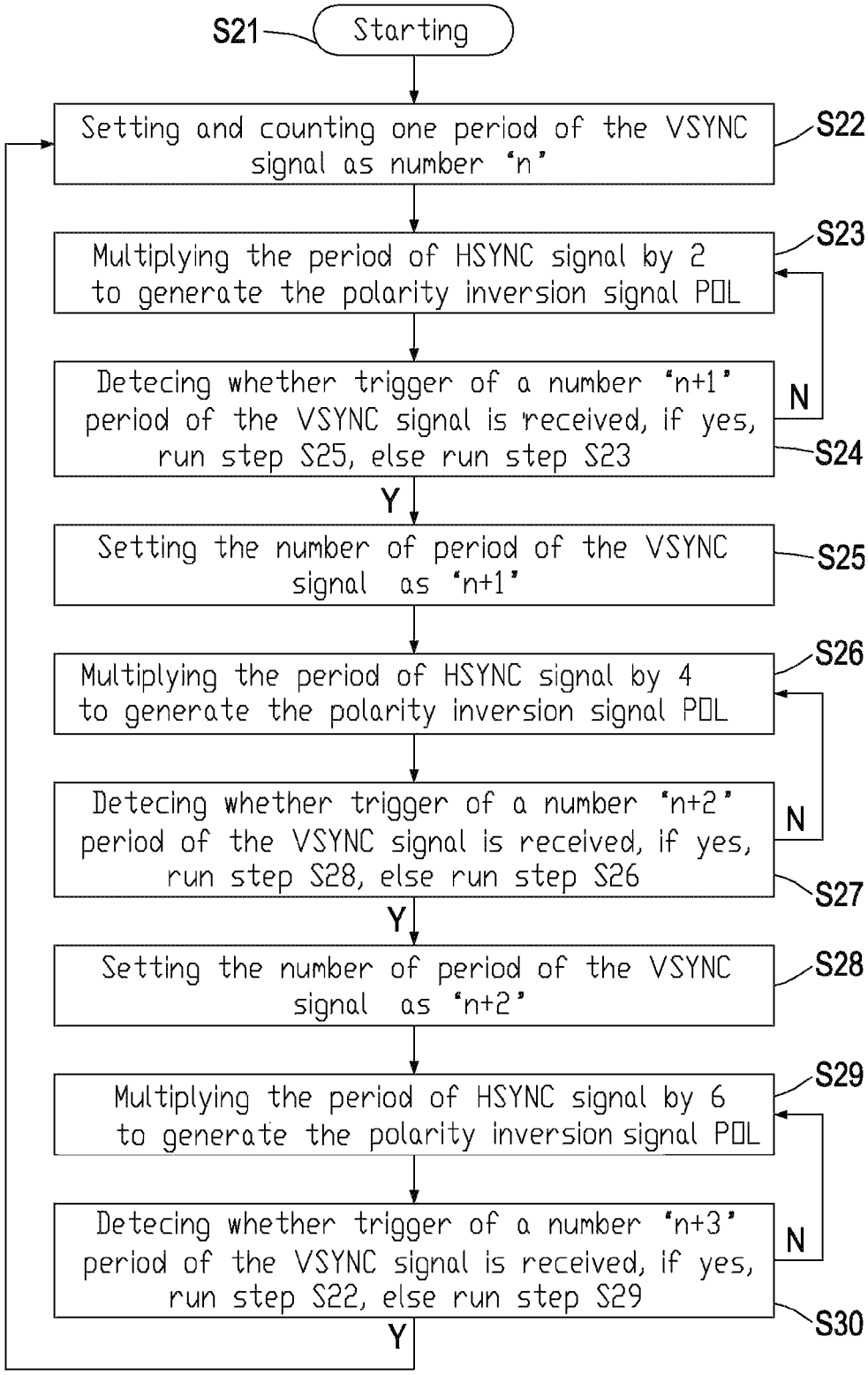
FIG. 8 is a flowchart of a second embodiment of a driving method of an LCD device in accordance with the present disclosure.
Figure 9:
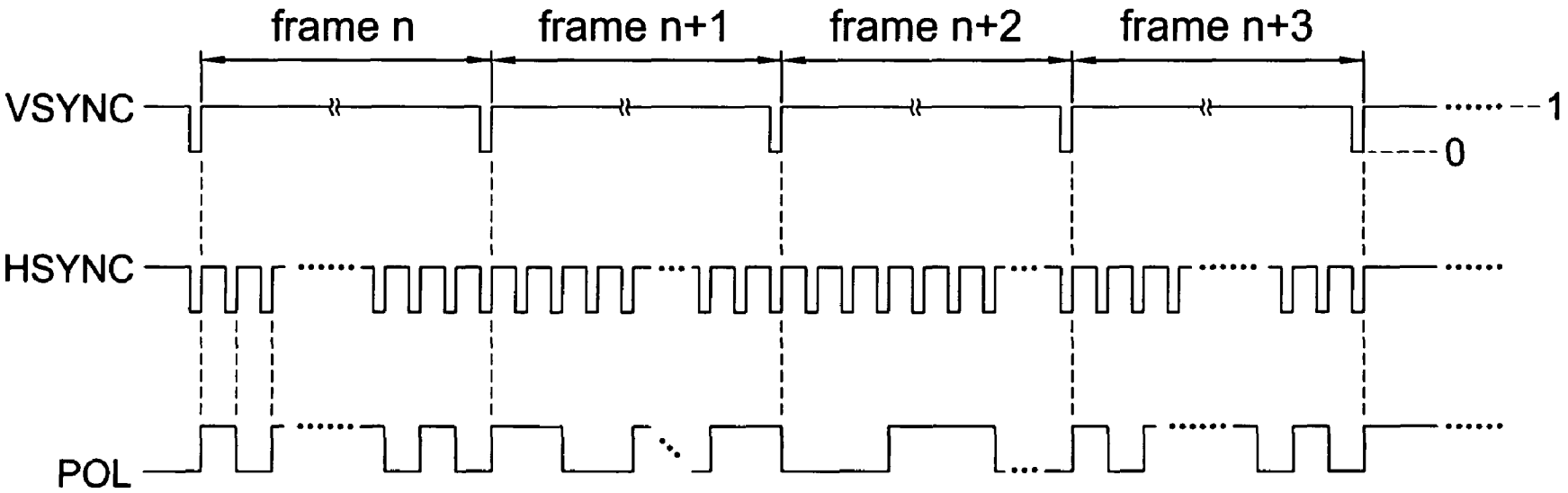
FIG. 9 is a sequence diagram of a VSYNC signal, an HSYNC signal, and a polarity inversion signal in the method of FIG. 8.

FIG. 8 is a flowchart of a second embodiment of a driving method of an LCD device. FIG. 9 is a sequence diagram of a VSYNC signal, an HSYNC signal, and a polarity inversion signal POL of the method of FIG. 8. The driving method follows.

In step S21, the method is initiated.

In step S22, one period of the VSYNC signal is set and counted as number "n." When the timing controller 50 receives the VSYNC signal and detects a trigger (the voltage of the VSYNC from the low level (0) to the high level (1)) in the VSYNC signal, the timing controller 50 runs the control program in the memory 60 to set the period of the VSYNC having the trigger as number "n." The "n" is an integer.

In step S23, the period of HSYNC signal is doubled to generate the polarity inversion signal POL. The timing controller 50 runs the control program in the memory 60 to double the period of HSYNC signal to be the period of the polarity inversion signal POL, and sends the polarity inversion signal POL to the common voltage generating circuit 40.

In step S24, it is determined whether the trigger of a number "n+1" period of the VSYNC signal has been received. If so, S25 is implemented. If not, step S23 is repeated. The timing controller 50 continuously receives the VSYNC signal and detects whether the trigger of the number "n+1" period of the VSYNC signal has been read, that is, if a subsequent frame is to be displayed by the LCD device 1. If yes, the timing controller 50 implements step S25. If not, step S23 is repeated.

In step S25, the number of period of the VSYNC signal is set as "n+1."

In step S26, the period of HSYNC signal is multiplied by 4 to generate the polarity inversion signal POL. The timing controller 50 runs the control program in the memory 60 to multiply the period of HSYNC signal by 4 to be the period of the polarity inversion signal POL, and sends the polarity inversion signal POL to the common voltage generating circuit 40.

In step S27, the timing controller 50 determines whether the trigger of a number "n+2" period of the VSYNC signal has been received. If so, step S28, is implemented. In not, step S26 is repeated.

In step S28, the number of period of the VSYNC signal is set as "n+2."

In step S29, the period of HSYNC signal is multiplied by 6 to generate the polarity inversion signal POL. The timing controller 50 runs the control program in the memory 60 to multiply the period of HSYNC signal by 6 to be the period of the polarity inversion signal POL, and sends the polarity inversion signal POL to the common voltage generating circuit 40.

In step S30, it is determined whether the trigger of a number "n+3" period of the VSYNC signal has been received. If so, step S22 is repeated. If not, step S29 is repeated. The timing controller 50 continuously receives the VSYNC signal and determines whether the trigger of the number "n+2" period of the VSYNC signal has been read, that is, a subsequent frame is to be displayed by the LCD device 1. If so, the timing controller 50 implements step S22 and starts to generate the subsequent period of the polarity inversion signal POL. If not, step S29 is repeated.

Figure 10:
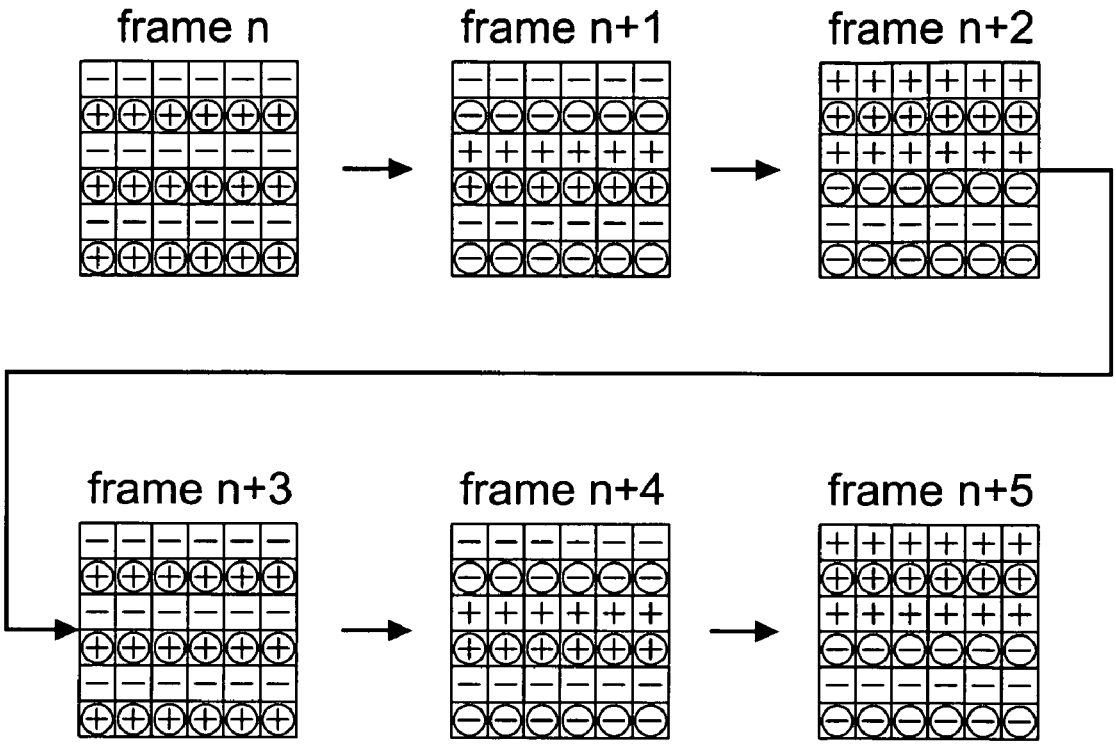
FIG. 10 is a driving motion analysis of an LCD device displaying a 1-line row flicker pattern, the LCD device utilizing the driving method of FIG. 8.
Figure 11:
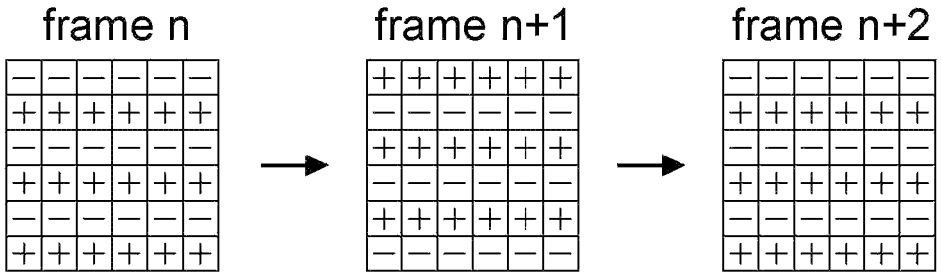
FIG. 11 (PRIOR ART)
FIG. 11 represents a driving method of a 1-line row inversion driving method in accordance with the related art.
Figure 12:
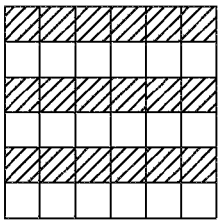
FIG. 12 (PRIOR ART)
FIG. 12 represents a 1-line row flicker pattern of an LCD device adopting the 1-line row inversion driving method in accordance with the related art.
Figure 13:
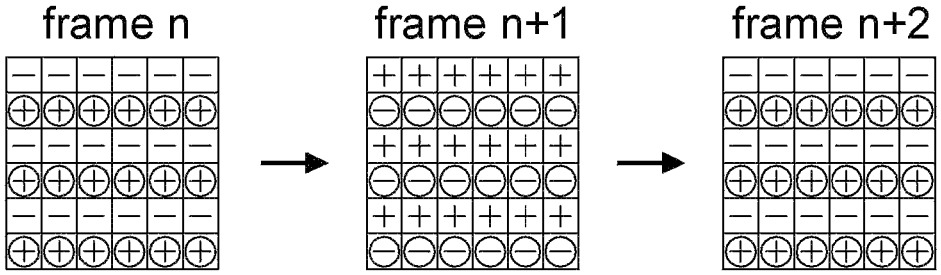
FIG. 13 (PRIOR ART)
FIG. 13 is a driving motion analysis of the LCD device in FIG. 12.
Figure 14:
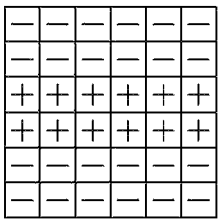
FIG. 14 (PRIOR ART)
FIG. 14 represents a 2-line row inversion driving method in accordance with the related art.
Figure 15:
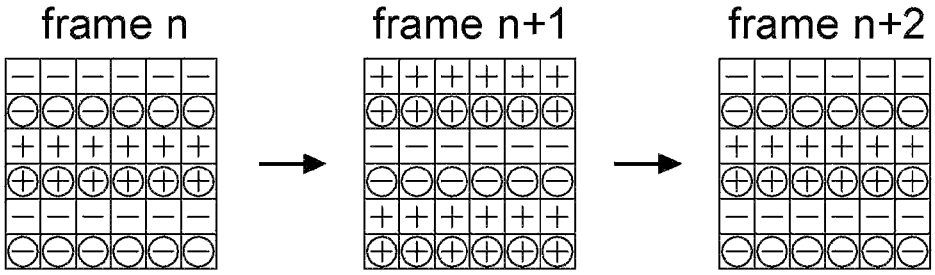
FIG. 15 (PRIOR ART)
FIG. 15 is a driving motion analysis of the LCD device displaying the 2-line row flicker patter in FIG. 14.
Figure 16:
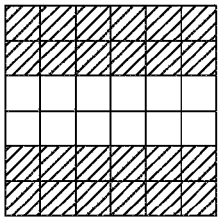
FIG. 16 (PRIOR ART)
FIG. 16 represents a 2-line row flicker pattern of the LCD device adopting the 2-line row inversion driving method in accordance with the related art.
Figure 17:
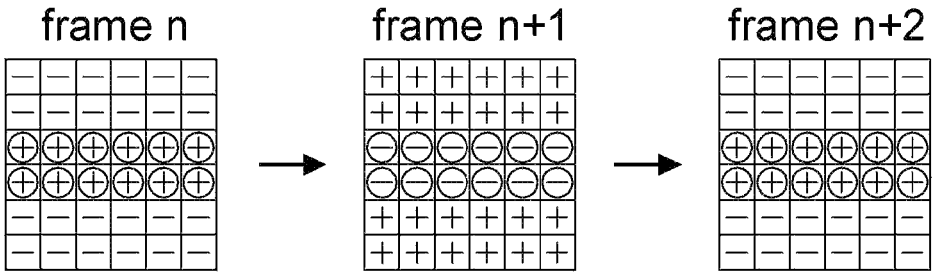
FIG. 17 (PRIOR ART)
FIG. 17 is a driving motion analysis of the LCD displaying the 2-line row flicker pattern in FIG. 16.

FIG. 10 shows a driving motion for six frames of the method of FIG. 8. Frames "n" and "n+3" are driven by 1-line row inversion, frames "n+1" and "n+4" are driven by 2-line row inversion, frames "n+2" and "n+5" are driven by 3-line row inversion driving method. Frames "n" to "n+2" is one period in accordance with the polarity inversion signal POL. Herein, the period of the polarity inversion signal POL is extended, so that a part of the pixels 13 on the illuminated state are driven by the positive bias direction voltages, other parts are driven by the negative bias direction voltages. Therefore, the brightness difference between the adjacent frames is reduced, and the flicker problem of the LCD device 1 is reduced.

Moreover, the control program in the memory 60 may be designed to change the driving method of the LCD device 1. The period of the polarity inversion signal POL may be extended by performing three steps, and the three steps includes a step of counting the period of the VSYNC signal, a step of multiplying the period of HSYNC signal, and a step of detecting whether the VSYNC signal is low voltage level (e.g., a logical zero) so that period of bias direction of the common voltage VCOM corresponding to polarity inversion signal POL may also be extended, such like four frames, five frames or six frames as one period. Since the polarity inversion signal POL and the corresponding common voltage VCOM may be extended unlimitedly to be random, the flicker is then substantially eliminated.

As an example, if the period of the common voltage VCOM is two frames, the period of the waveforms of the common voltage VCOM for the two frames may be respectively defined as two times and six times to the gate-scanning signals.

Also, if the period of the common voltage VCOM is two frames, the period of the waveforms of the common voltage VCOM for the two frames may be respectively defined as four times and six times to the gate-scanning signals.

Furthermore, when the period of the common voltage VCOM is three frames, the period of the waveforms in two of the frames of common voltage VCOM may be identical but inversed, and the waveform of a rest frame of the common voltage VCOM has a different period from the other two waveforms.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A liquid crystal display (LCD) device, comprising: a liquid crystal display panel, comprising multiple gate lines, multiple data lines and multiple pixels having a common electrode, the data lines intersecting with and electronically isolated from the gate lines;

a gate driving circuit to successively send gate-scanning signals to the gate lines, respectively;

a common voltage generating circuit to send a common voltage to the common electrode; and a data driving circuit to send a gray level voltage signal to the data lines while one of the gate lines is being scanned, the gray level voltage signal comprising multiple voltage levels sent to the data lines, respectively, wherein the common voltage comprises at least three square waves having three non-identical periods, each of the at least three square waves corresponds to a frame period and has a substantially constant period, and the at least three square waves comprise a first square wave having a first period which is twice the period of each gate-scanning signal, a second square wave having a second period which is four times to the period of each gate-scanning signal, and a third square wave having a third period which is six times to the period of each gate-scanning signal.

2. The liquid crystal display device of claim 1, wherein a duty ratio of each square wave of the common voltage is about 50%.

3. The liquid crystal display device of claim 2, further comprising a timing controller to generate a polarity inversion signal, wherein the common voltage is generated according to the polarity inversion signal.

4. The liquid crystal display device of claim 3, wherein the timing controller comprises a memory comprising a control program, the control program controlled by the timing controller to generate the polarity inversion signal for the common voltage generating circuit according to an input vertical synchronization (VSYNC) signal and a horizontal synchronization (HSYNC) signal.

5. The liquid crystal display device of claim 4, wherein the polarity inversion signal comprises serial square waves comprising at least two non-identical frame periods, the serial square waves in each of the at least two non-identical frame periods of the polarity inversion signal in one frame comprising a constant frame period and a duty ratio of about 50%, and wherein the constant frame period of the polarity inversion signal in each one frame is 2k times a period of the HSYNC signal, and k is a positive integer except zero.

6. The liquid crystal display device of claim 5, wherein the common voltage generating circuit generates the common voltage having a positive bias direction when the received polarity inversion signal is at a high voltage level.

7. A driving method of a liquid crystal display (LCD) device, the liquid crystal display device comprising a liquid crystal display panel comprising multiple data lines, multiple gate lines intersected with the data lines, and a common electrode, wherein the driving method comprises:

sending gate-scanning signals to the gate lines, each gate-scanning signal comprising a period corresponding to one frame and substantially equal to a time interval to scan one gate line;

sending a common voltage to the common electrode; and sending multiple voltage levels of a gray level voltage signal respectively to the data lines during the time the liquid crystal display panel is scanned by the gate-scanning signals;

wherein the common voltage comprises at least three square waves having three non-identical periods, each square wave corresponds to a frame period and has a substantially constant period, and the at least three square waves comprise a first square wave having a first period which is twice the period of each gate-scanning signal, a second square wave having a second period which is four times to the period of each gate-scanning signal, and a third square wave having a third period which is six times to the period of each gate-scanning signal.

8. The driving method of claim 7, wherein a duty ratio of each square wave of the common voltage is about 50%.

9. The driving method of claim 8, wherein the liquid crystal display device further comprises a timing controller, and the driving method further comprises generating the common voltage before sending the common voltage to the common electrode.

10. The driving method of claim 9, wherein generating the common voltage further comprises:

applying a vertical synchronization (VSYNC) signal and a horizontal synchronization (HSYNC) signal to the timing controller;

generating a polarity inversion signal according to the VSYNC signal and the HSYNC signal, wherein the polarity inversion signal is serial square waves comprising at least two non-identical frame periods, the serial square waves in each non-identical frame period of the polarity inversion signal in one frame have a constant frame period and have a duty ratio of about 50%, the constant frame period of the polarity inversion signal in each one frame is 2k times a period of the HSYNC signal, and k is a positive integer except zero; and generating the common voltage according to the polarity inversion signal.

* * * * *